US005303603A

United States Patent [19]

Boots

[11] Patent Number: 5,303,603

[45] Date of Patent: Apr. 19, 1994

[54] METHOD FOR IMPARTING CYCLIC VERTICAL MOTION TO CAROUSEL ANIMALS

[76] Inventor: David A. Boots, 555 Concord Rd., Sudbury, Mass. 01776

[21] Appl. No.: 991,968

[22] Filed: Dec. 17, 1992

[51] Int. Cl.[5] ..... F16H 19/06; A63G 1/00

[52] U.S. Cl. ..... 74/37; 74/136; 74/138; 472/29; 472/34

[58] Field of Search ..... 74/37, 136, 137, 138, 74/139, 140, 141, 142; 40/414; 446/236; 472/28, 29, 34, 39

[56] References Cited

U.S. PATENT DOCUMENTS

| | | | |
|---|---|---|---|
| 536,853 | 4/1895 | Darling | 472/29 |
| 730,521 | 6/1903 | Doner | 472/34 |
| 822,677 | 6/1906 | Loiseleur | 472/29 |
| 1,088,558 | 2/1914 | Farnum | 472/34 X |
| 2,795,396 | 6/1957 | Davidson | 74/140 X |
| 3,603,583 | 9/1971 | Bartlett | 472/39 |

FOREIGN PATENT DOCUMENTS

| | | | |
|---|---|---|---|
| 357670 | 7/1938 | Italy | 472/29 |
| 15796 | of 0000 | United Kingdom | 472/29 |

*Primary Examiner*—Leslie A. Braun
*Assistant Examiner*—David W. Laub

[57] ABSTRACT

An arrangement of cables, pulleys and cams has been invented which provides a simple, reliable, flexible and inexpensive method of converting rotary carousel motion in the horizontal plane into vertical motion of animals on the carousel. A cam is attached to the center pole of the carousel. The cam is positioned so as to interact with cables which are routed from the carousel animals to be given subsidiary motion (typically up-down). For up-down motion each cable is routed vertically from its animal to the overhead support structure and then along a radial passing neat the center pole and is fastened to the overhead support radially opposite the animal being moved. As the carousel, with animals and cables, rotate around the center pole the cam sequentially intercepts the cables forcing the overhead table paths to lenghten and drawing the animals upward to accomodate the cable path change. As the carouser rotation carries the cables sequentially beyond reach of the cam the cable and horse is restored to its initial position. Continuing carousel rotation causes the cable cycle to continue repetitively.

1 Claim, 4 Drawing Sheets

METHOD FOR IMPARTING CYCLIC VERTICAL MOTION TO CAROUSEL ANIMALS

SUMMARY

The characteristic cyclical up-down motion of carousel horses as the carousel rotates is typically accomplished by suspending the animals from rotating cranks. Each crank terminates in a pinion gear which is meshed with a single, large, immobile, beveled, ring gear attached to the center pole. As the carousel frame turns around the center pole the pinion gears roll over the stationary ring gear causing the cranks to rotate and moving the horses up and down.

It is the object of the invention described in this specification to achieve vertical motion for carousel amimals in a manner that is not dependent upon Sears and cranks and is thereby free of the heavy mass and substantial expense associated with their use. The new method is inexpensive, simple, reliable and with flexibility of implementation to allow a variety of carousels to be constructed.

In the method of this invention each carousel horse is attached to a hanger rod which is connected to a flexible steel cable which is routed vertically to a pulley above the horse and then horizontally along the radius of the circular carousel frame, past the center pole, to an attachment point radially opposite to the horse location. A stationary cain, fixed to the center pole, is equipped with pulleys at each end; the cam is positioned such that the pulleys sequentially intercept the cables as the carousel frame rotates about the center pole. As the stationary cam makes contact with a cable it forces the cable aside and, with further rotation, releases it. This action causes the horizontal path of the cables to be sequentially lengthened and then restored. Since the cable length is fixed the lengthening of the overhead horizontal path is associated with a corresponding shortening of the vertical cable path thereby drawing the horse upward and then, as the cam releases the cable, allowing it to return downward. Continuous rotary motion of the carousel frame provides continuous repetitive vertical motion of the horses attached to the cables.

IDENTIFICATION OF DRAWING

Four drawings accompany this patent application. FIG. 1 illustrates the construction of a typical carousel and is used to acquaint the reader with its construction and its various parts. FIG. 1A is a vertical cross section in the vicinity of the center pole while FIG. 1B is a horizontal section at the level of the radical sweeps.

FIG. 2 provides more detail showing how a conventional carousel is arranged to provide movement to an individual horse.

FIG. 3 is a simplified drawing of the new concept showing an arrangement for one horse.

FIG. 4 illustrates the cabling arrangement of the invention near the center pole for an eight horse carousel.

DETAILED DESCRIPTION

Figure 1A:
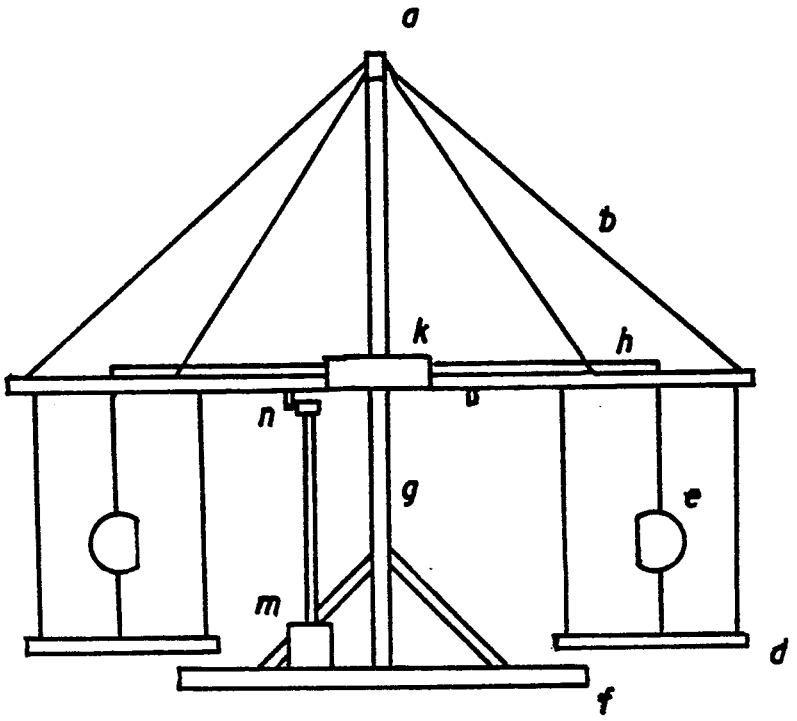
PRIOR ART Figure 1A
Figure 1B:
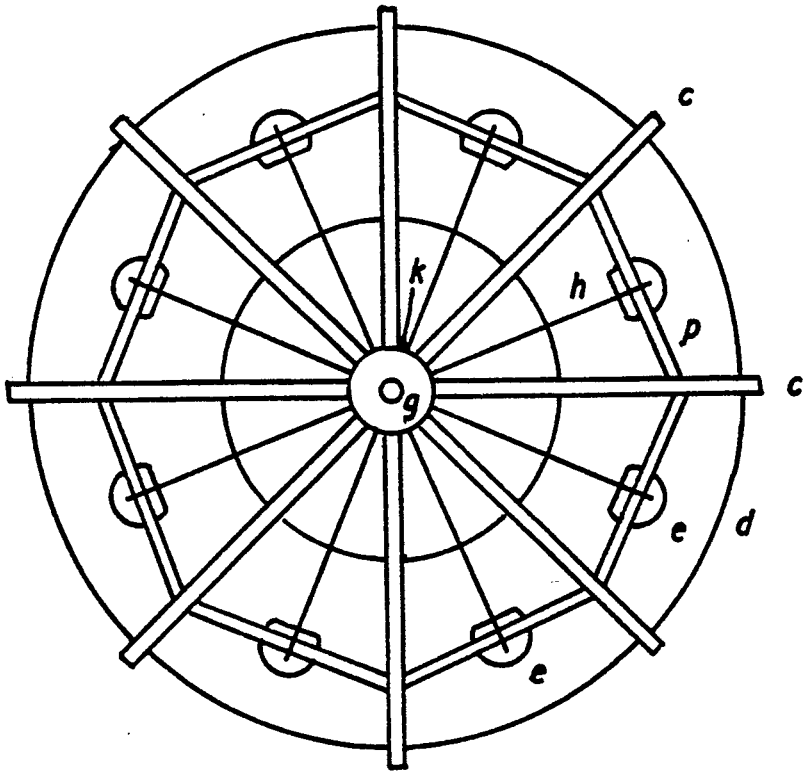
PRIOR ART Figure 1B

The construction of carousels has been basically unchanged for nearly one hundred years although improvements to motors, bearings and other components have been made as technology advanced. The basic structure and drive systems are essentially the same on-all (non-track type) carousels. FIGS. 1A and 1B illustrate the structure of a typical carousel, the letters on the FIGS. are used to identify the various part: the letter part association is the same for all Figures accompanying this application. On FIGS. 3 and 4 the identifying letters are accompanied with primes to distinguish the new arrangement of similar parts.

A key to understanding the carousel mechanism is to mentally separate the stationary parts from the moving parts. Refering to FIGS. 1A and 1B, note that the entire circular structure of the carousel is suspended from the center pole,g, which is stationary and held vertically upright by the base structure, f. The radial sweeps, c, are attached at their center ends to a hub/bearing arrangement, k, and are held horizontal by guy rods, b, which are attached to a center pole cap called a spider, a. The sweeps, c, are held at the correct angular positions by spreaders, p. When sweeps, spreaders and guys are all in position the sweeps and spreaders form a rigid disc which is capable of easily rotating about the center pole due to its inherent balance and the bearings incorporated in the spider, a, and the hub, k. The platform ring, d, is suspended by a set of platform hangers descending from the sweeps, c. A motor, m, is connected to a drive shaft and pinion gear which is meshed with the main drive gear bolted to the underside of the sweeps. This drive gear set is identified as n in FIG. 1A.

The method of deriving and transmitting the vertical motion to the carousel animals is the subject of this invention. FIGS. 1A and 1B have been made sufficiently general that they can apply to either the old or the new method. FIGS. 2,3 and 4 will make the appropriate technique distinctions. For the introductory purpose of FIG. 1 allow that the hub arrangement, k, in addition to supporting the ends of the sweeps, c, and housing a bearing also incorporates a means to convert rotational energy from the horizontal plane to the vertical plane and to apportion it to each horse, e, via mechanical transmission devices, h.

Figure 2A:
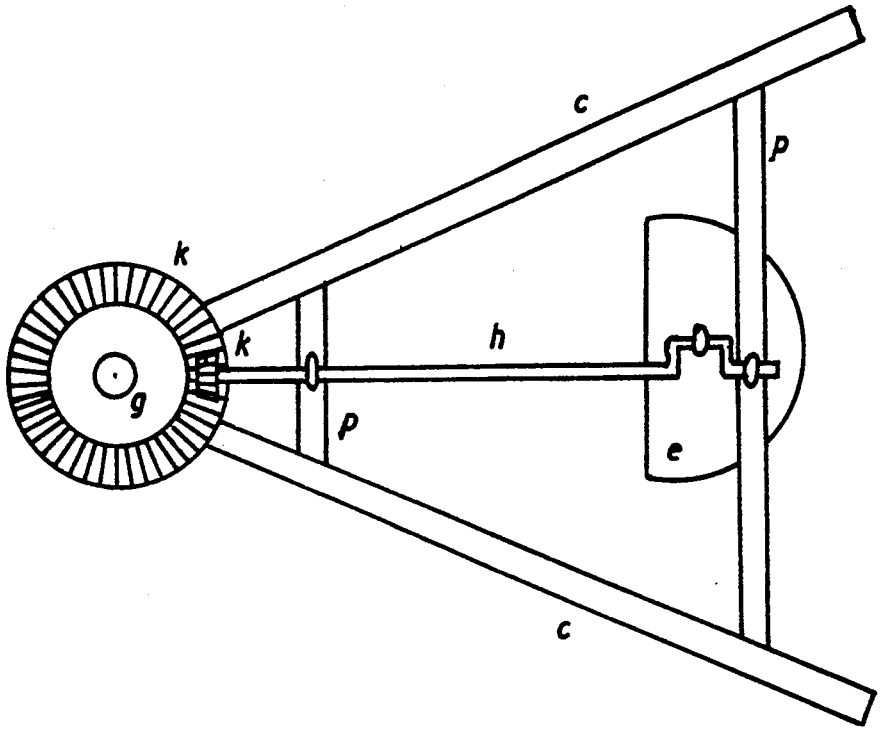
PRIOR ART Figure 2A
FIG. 2A is a horizontal section.
Figure 2B:
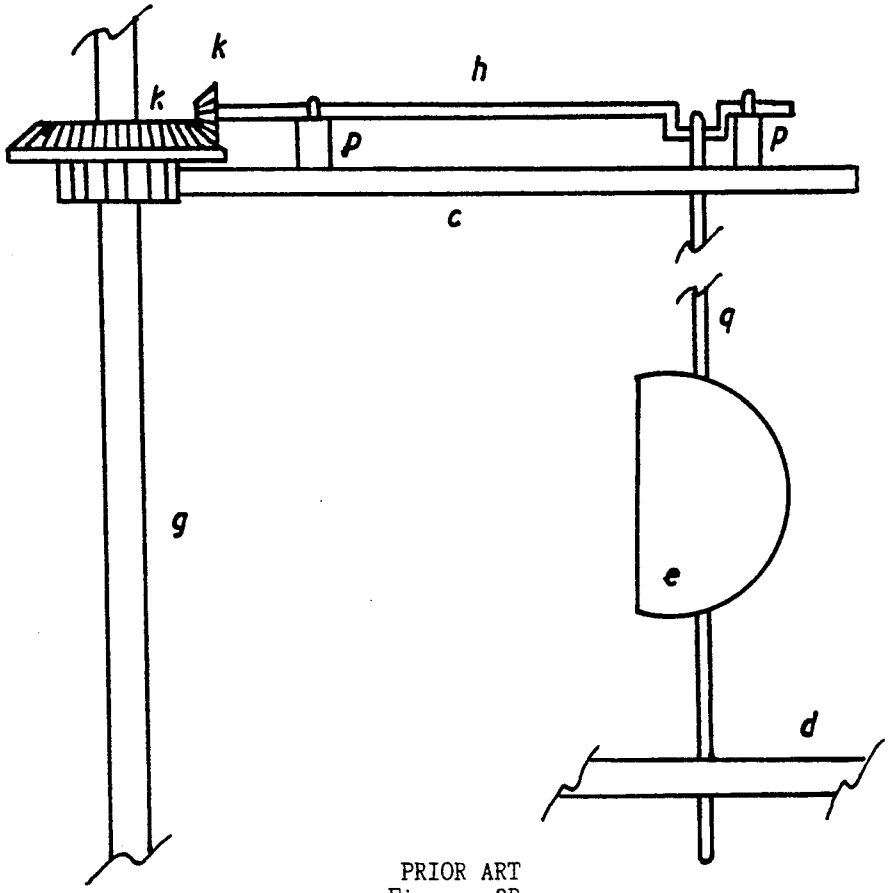
PRIOR ART Figure 2B
FIG. 2B is a vertical section along a radius of the frame.

FIGS. 2A and 2B illustrate the conventional (old) method of deriving and transmitting vertical motion to the horses. The hub arrangement is more fully shown. The large bevel ring gear, k1, is fixed to the centerpole, g, and never turns. A hub, r, incorporates a bearing whose inner race is fixed to the center pole and whose outer race is mated to a structure to support the sweep ends, c. As a result the disc of sweeps can rotate about the center pole. Cranks are typically supported on spreaders, p, between pairs of sweeps, c. At the end of each crankshaft is a pinion gear, k2, which is forced to turn as the sweep disc (frame) rotates about the center pole and the pinion rolls around the bevel ring gear, k1. A horse hanger, q, is coupled to the crank and causes the horse, e, to move up and down as the carousel rotates and the crank turns.

Figure 3A:
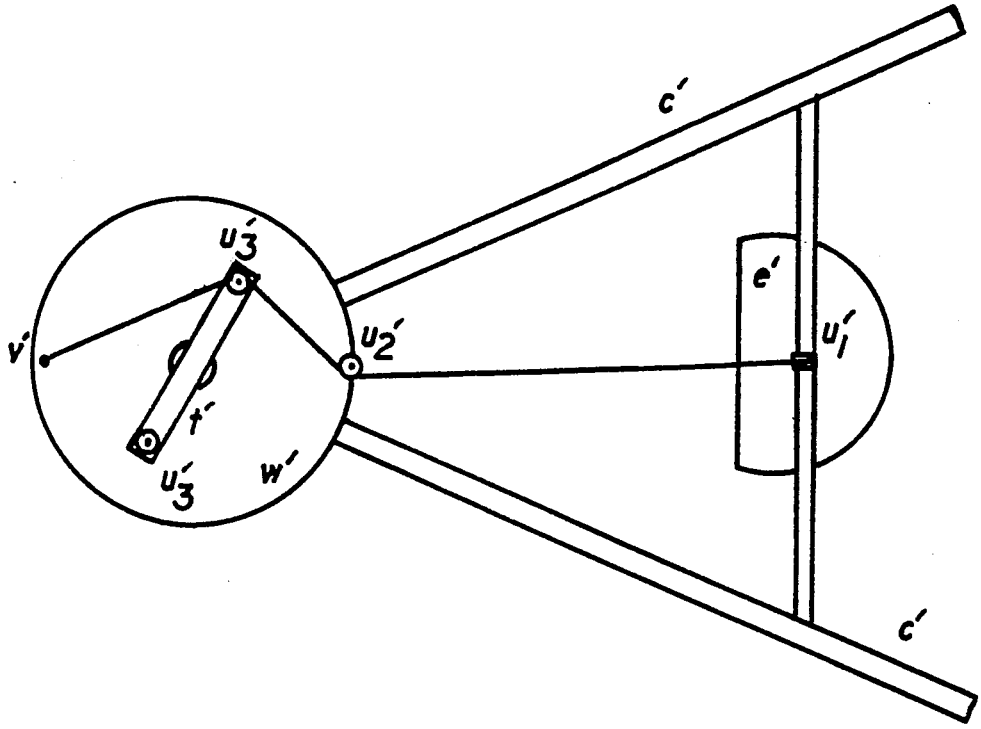
FIGS. 3A and 3B provide the same view orientation as FIGS. 2A and 2B.
Figure 3B:
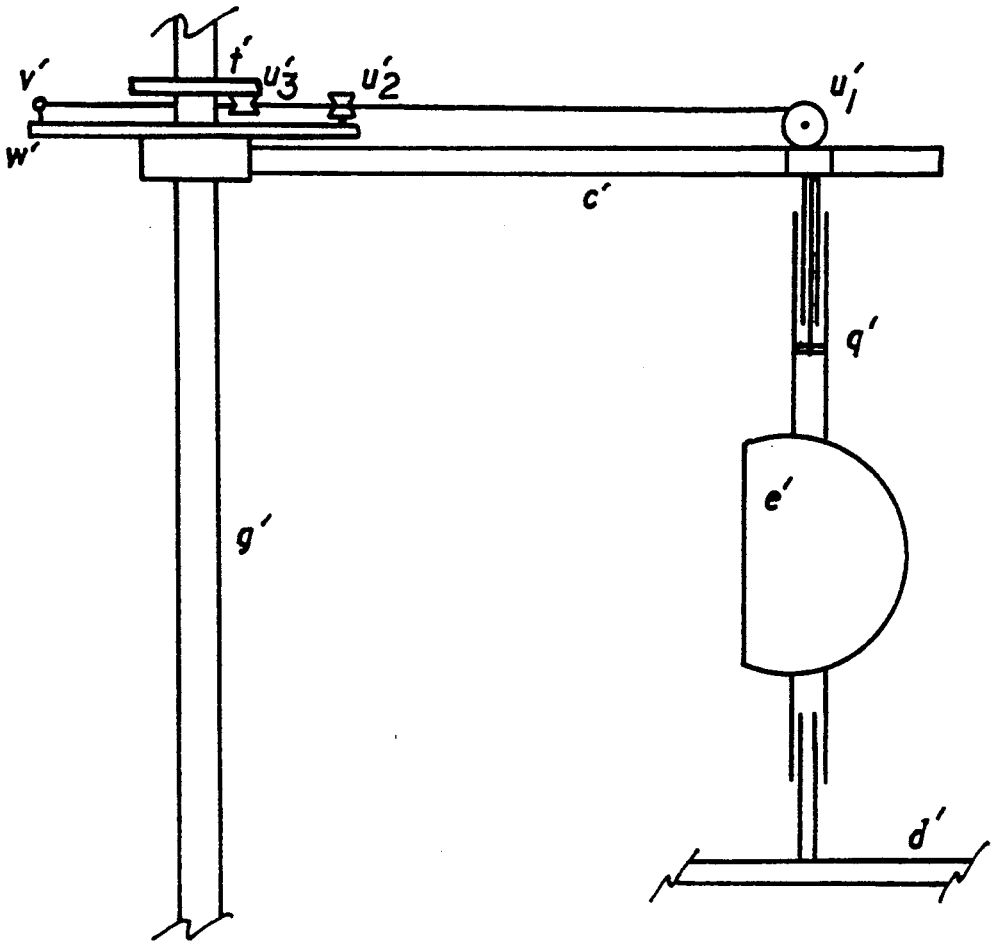

The new method of this invention is illustrated in FIGS. 3A and 3B. Each horse is attached to its hanger pipe, q'. The hanger pipe is held vertical by two concentric pipes that slip inside the hanger pipe and are fixed at one end to the platform, d', and at the other to the overhead spreader, p'. As a result the horse and hanger pipe can slide up and down, a distance of about one foot, between the platform and spreader.

A flexible steel cable 2', is attached at one end to the horse hanger pipe and is routed inside the pipe to emerge at the spreader, p', attachment point of the upper inner pipe. The cable is routed over a pulley, u1', the spreader and thence horizontally to another pulley, u2', on an inner disc, w', bolted to the sweeps, c'. The cable passes the center pole, g', and is attached to the opposite side of the disc, w', at point v'. The sweeps, cables and inner disc all rotate about the center pole. A cam, t', is firmly attached to the center pole and does not move. Each end of the cam is equipped with a pulley, u3', which is positioned vertically so that it will intercept the cable, s', as the sweeps and cable rotate past the immobile cam, t'. As the rotation procedes the cable makes contact with the cam pulley, u3', further rotation causes the cable to be pushed aside thereby increasing the horizontal path of the cable, and reducing the vertical path, moving the horse upward. As rotation continues the maximum cable deflection occurs and, with continuing rotation, the cable is gradually released allowing the horse to move downward under force of gravity. As the can, pulley, u3', releases the cable the pulley at the other end of the cam is about to make contact and create another up-down cycle. As shown in FIGS. 3A and 3B the horse would receive two up-down cycles per one revolution of the carousel frame. A variation of the number of cams,t', and their locations can change the cyclic ratio, if desired.

Figure 4A:
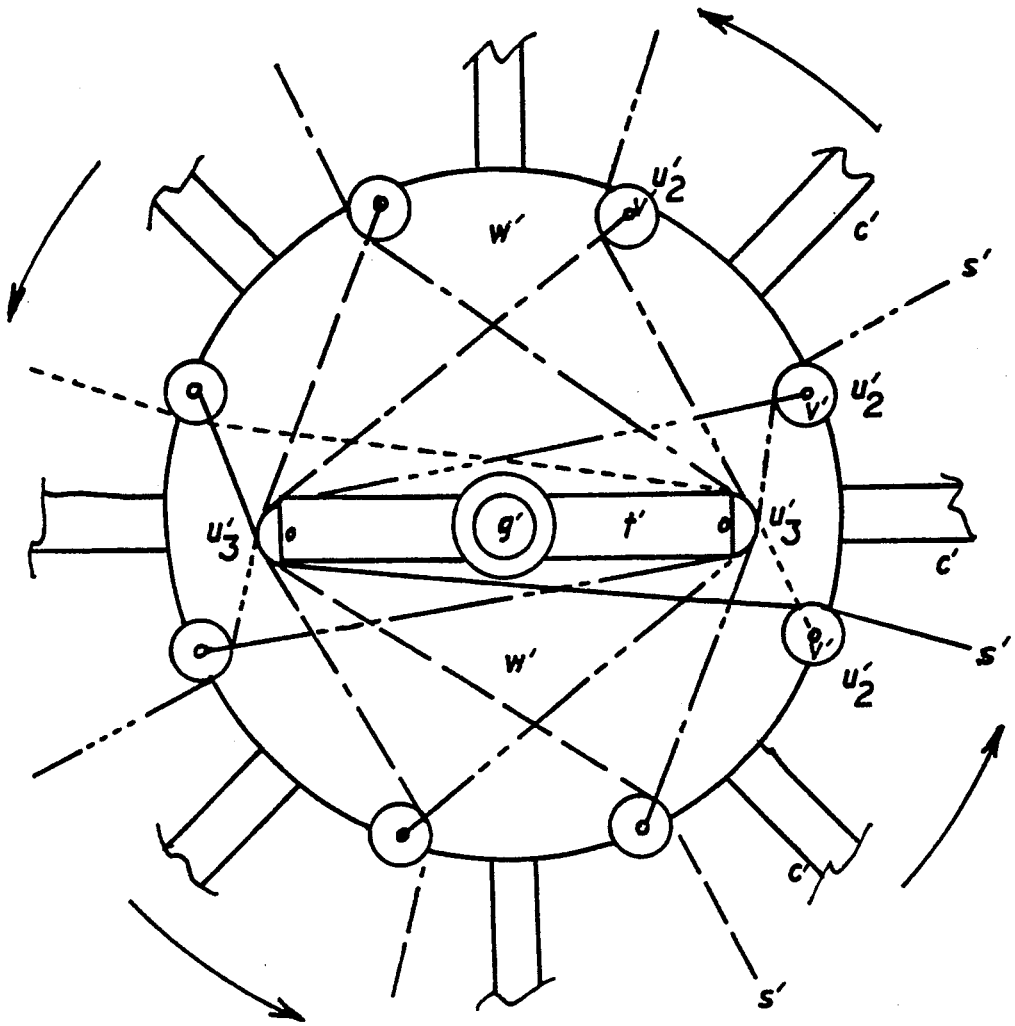
FIG. 4A is a horizontal section.
Figure 4B:
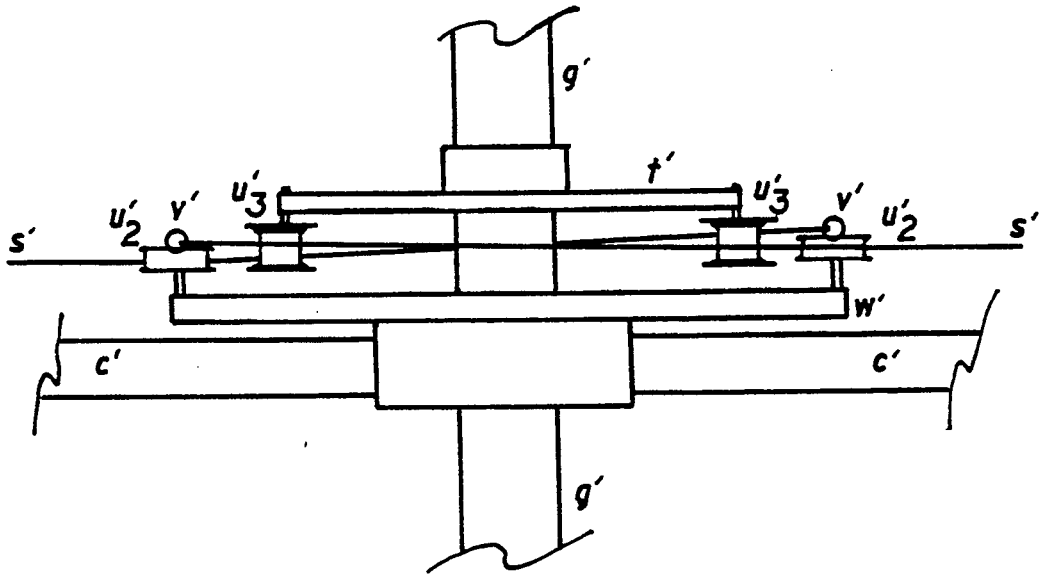
FIG. 4B is a vertical section.

FIGS. 4A and 4B show cable arrangement appropriate for 8 horses (or 16 horses for a 2 abreast horse configuration). The cable path drawing shown in FIG. 4A use different cable line patterns to help the viewer identify the various cables and their routing. Note that, with the arrangement shown, some horses will be moving up while others are moving down; again two complete up-down cycles per horse are afforded with each carousel rotation, i.e., each complete rotation of disc, w', past cam, t'.

The relative heights of the cables in the horizontal plane can be adjusted with spacers under pulleys, u2', to minimize rubbing between the cables.

I claim:

1. An arrangement of cables, pulleys and cams for use in a carousel structure, said arrangement providing a rotary motion into subsidiary, reciprocating up-down motion, said arrangement including at least one unit to be given an up-down motion, a cable having a first end being attached to said unit, said cable having a first direction around a pulley and a second cable portion extending in a second direction, which is substantially orthogonal to said first direction, a rotating structure having an axis of rotation, said cable having a second end attached to a point on said rotating structure opposite said unit whereby the length of the second cable portion is greater than the distance between the axis of said rotating structure and said pulley; a stationary cam which intercepts the cable means as it rotates around the axis causing the cable to be pushed aside thereby lengthening the second cable portion causing a corresponding shortening of the first cable portion and resulting in a motion of the unit in a first direction from a first position, and whereby continuation of said rotation releases the second cable portion from the stationary cain causing a shortening of said second cable portion thereby restoring said unit to its first position.

* * * * *